US009173447B2

(12) United States Patent
Boakye

(10) Patent No.: US 9,173,447 B2
(45) Date of Patent: Nov. 3, 2015

(54) SHOE PROTECTING COVER DEVICE

(71) Applicant: Kwabena Boakye, Jeffersonville, PA (US)

(72) Inventor: Kwabena Boakye, Jeffersonville, PA (US)

( * ) Notice: Subject to any disclaimer, the term of this patent is extended or adjusted under 35 U.S.C. 154(b) by 0 days.

(21) Appl. No.: 14/224,170

(22) Filed: Mar. 25, 2014

(65) Prior Publication Data

US 2015/0272266 A1 Oct. 1, 2015

(51) Int. Cl.

| | |
|---|---|
| ***A43B 3/02*** | (2006.01) |
| ***A43B 3/12*** | (2006.01) |
| ***A43B 13/22*** | (2006.01) |
| ***A43B 3/16*** | (2006.01) |
| ***A43B 3/10*** | (2006.01) |

(52) U.S. Cl.

CPC ... *A43B 3/16* (2013.01); *A43B 3/10* (2013.01); *A43B 3/122* (2013.01); *A43B 3/128* (2013.01)

(58) Field of Classification Search

CPC ..... A43B 3/10; A43B 3/106; A43B 3/108; A43B 3/12; A43B 3/124; A43B 3/126; A43B 3/128; A43B 3/16; A43B 3/22; A43B 5/12

USPC ..... 36/72 R, 62, 7.1 R, 113, 131, 8.3

See application file for complete search history.

(56) References Cited

U.S. PATENT DOCUMENTS

| | | | | |
|---|---|---|---|---|
| 204,483 | A * | 6/1878 | Cunningham | 36/7.5 |
| 237,887 | A * | 2/1881 | McCaffrey | 36/7.5 |
| 3,609,888 | A | 10/1971 | Rickman | |
| 4,779,360 | A | 10/1988 | Bible | |
| 4,825,563 | A * | 5/1989 | Strongwater | 36/73 |
| 6,405,459 | B1 | 6/2002 | Prevost et al. | |
| 7,997,008 | B2 | 8/2011 | Coomer | |
| D650,563 | S | 12/2011 | Bonavita | |
| 8,215,030 | B2 | 7/2012 | Bowen et al. | |
| 2008/0010854 | A1 * | 1/2008 | Sokolowski | 36/8.3 |
| 2008/0022555 | A1 | 1/2008 | Mor et al. | |
| 2008/0034613 | A1 * | 2/2008 | Wilkenfeld et al. | 36/8.3 |
| 2008/0086906 | A1 * | 4/2008 | Wilkenfeld | 36/8.3 |

* cited by examiner

*Primary Examiner* — Jila M Mohandesi
*Assistant Examiner* — Katharine Gracz

(57) ABSTRACT

A shoe protecting cover device covers a shoe while driving to prevent scuffing or other damage to the shoe. The device includes a base wall and a perimeter wall coupled to and extending from a front section of the base wall. The perimeter wall and the front section of the base wall define a front cup for receiving and extending over a front portion of a shoe. An arcuate sidewall is coupled to a rear section of the base wall defining a heel cup for receiving and extending around a heel portion of the shoe. The front cup, the heel cup, and a medial section of the base wall define a cover. A strap extends from the cover for coupling the cover to the shoe such that the base wall extends along a sole of the shoe.

8 Claims, 2 Drawing Sheets

SHOE PROTECTING COVER DEVICE

BACKGROUND OF THE DISCLOSURE

Field of the Disclosure

The disclosure relates to covering devices and more particularly pertains to a new covering device for covering a shoe while driving to prevent scuffing or other damage to the shoe.

SUMMARY OF THE DISCLOSURE

An embodiment of the disclosure meets the needs presented above by generally comprising a base wall and a perimeter wall coupled to and extending from a front section of the base wall. The perimeter wall and the front section of the base wall define a front cup for receiving and extending over a front portion of a shoe. An arcuate sidewall is coupled to a rear section of the base wall defining a heel cup for receiving and extending around a heel portion of the shoe. The front cup, the heel cup, and a medial section of the base wall define a cover. A strap extends from the cover for coupling the cover to the shoe such that the base wall extends along a sole of the shoe.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
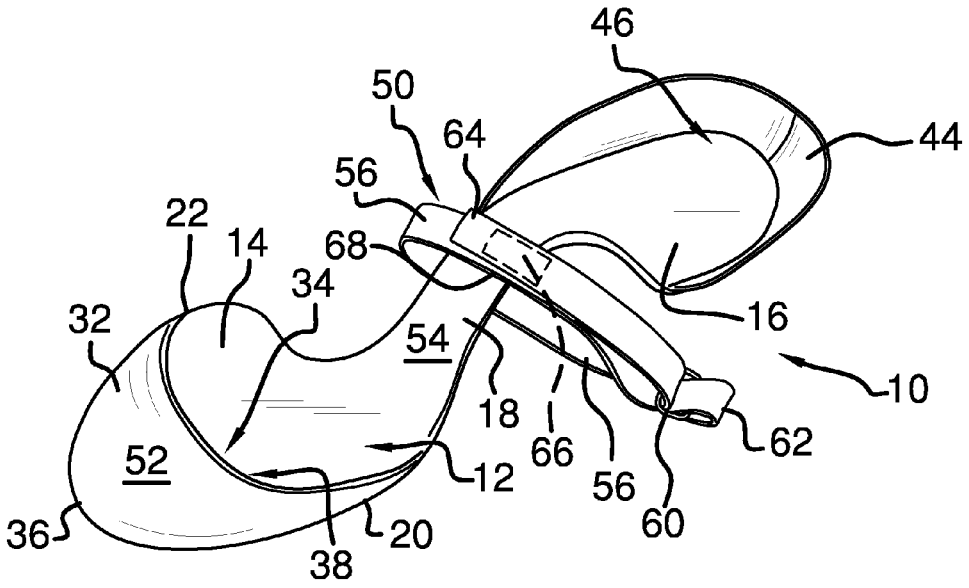
FIG. 1 is a top front side perspective view of a shoe protecting cover device according to an embodiment of the disclosure.
Figure 2:
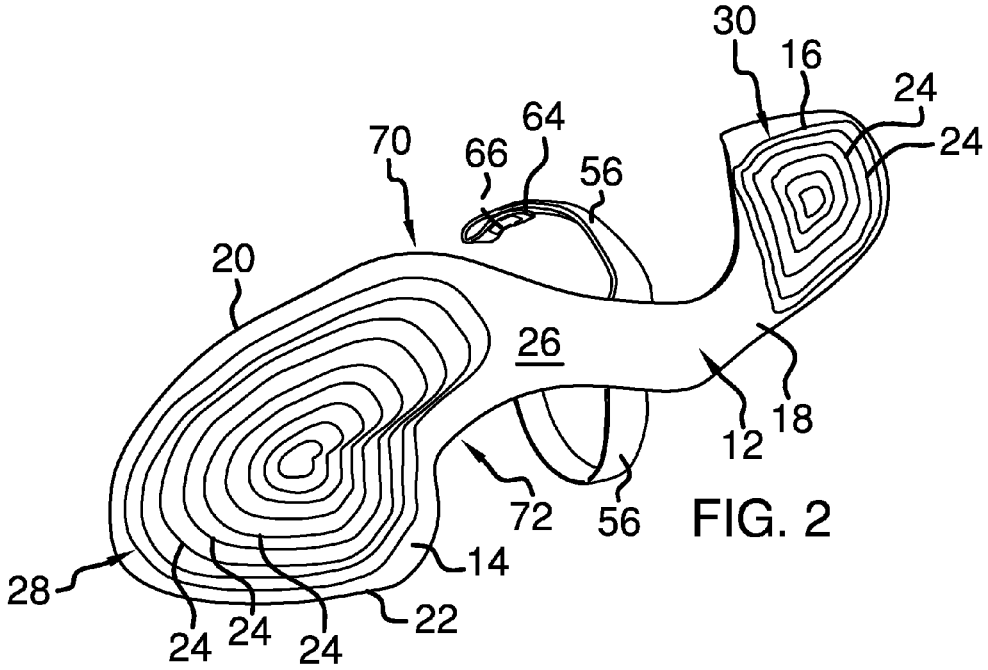
FIG. 2 is a bottom view of an embodiment of the disclosure.
Figure 3:
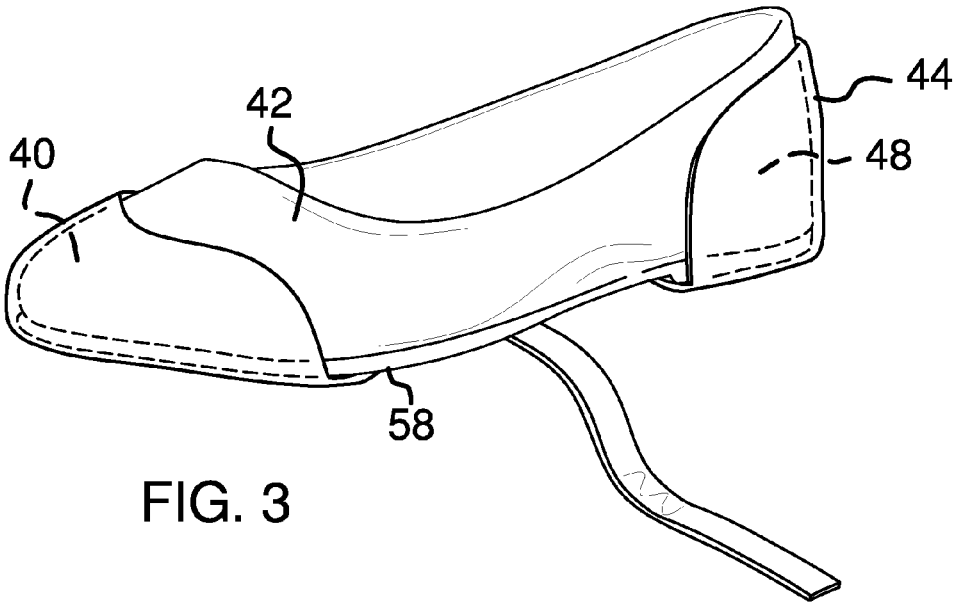
FIG. 3 is a top front side perspective view of an embodiment of the disclosure in an unsecured position on a shoe.
Figure 4:
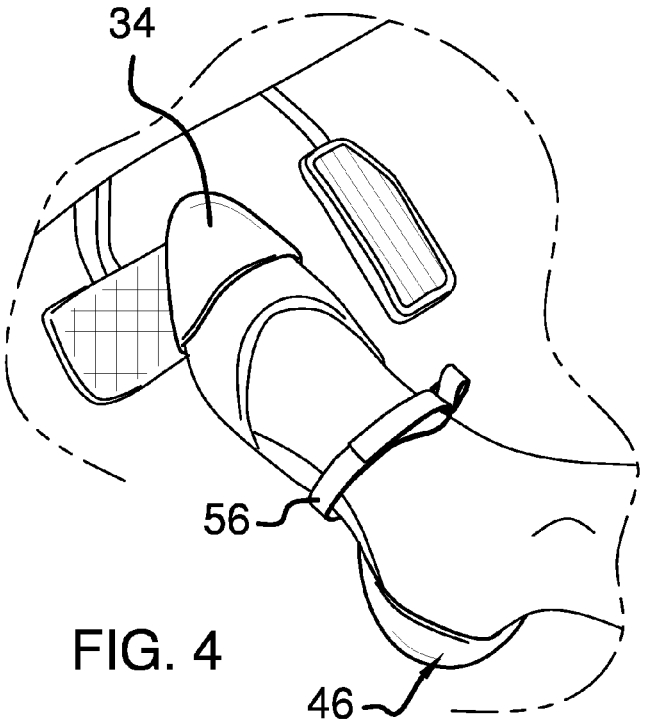
FIG. 4 is a top side perspective view of an embodiment of the disclosure in use.

With reference now to the drawings, and in particular to FIGS. 1 through 4 thereof, a new covering device embodying the principles and concepts of an embodiment of the disclosure and generally designated by the reference numeral 10 will be described.

As best illustrated in FIGS. 1 through 4, the shoe protecting cover device 10 generally comprises a base wall 12 having a front section 14, a rear section 16, and a medial section 18 extending between the front section 14 and the rear section 16. An outer side 20 of the front section 14 of the base wall 12 has a length greater than a length of an inner side 22 of the front section 14 of the base wall 12. Each of a plurality of ridges 24 extends into a bottom surface 26 of the base wall 12. The ridges 24 are arranged into a front array 28 positioned on the front section 14 of the base wall 12 and a heel array 30 positioned on the rear section 16 of the base wall 12. The ridges 24 of each of the front array 28 and the heel array 30 respectively are concentrically spaced.

A perimeter wall 32 is coupled to and extends from the front section 14. The perimeter wall 32 and the front section 14 of the base wall 12 define a front cup 34 having a closed front end 36 and an open back end 38 wherein the front cup 34 is configured for receiving and extending over a front portion 40 of a shoe 42. The front cup 34 is configured to cover a substantial amount of the shoe 42 to prevent scuffing of the shoe 42 while operating the pedals of a vehicle.

An arcuate sidewall 44 is coupled to and extends upwardly from the rear section 16 of the base wall 12. The sidewall 44 and the rear section 16 of the base wall 12 define a heel cup 46 configured for receiving and extending around a heel portion 48 of the shoe 42. Together, the front cup 34, the heel cup 46, and the medial section 18 of the base wall 12 define a cover 50. An outer surface 52 of the cover 50 may comprise a durable synthetic material such as synthetic leather or the like. An inner surface 54 of the cover 50, particularly of portions abutting an outer surface of an upper of the shoe 42, may comprise a soft leather material, felt, or the like.

A strap 56 is coupled to and extends from the cover 50 and may extend more particularly from the medial section 18 of the base wall 12, wherein the cover 50 is configured for coupling to the shoe 42 such that the base wall 12 extends along a sole 58 of the shoe 42. A loop 60 is coupled to a first end 62 of the strap 56. A second end 64 of the strap 56 is insertable through the loop 60. A fastener 66, such as hook and loop fastener, a snap, or the like, is coupled to the strap 56 wherein the second end 64 of the strap 56 is securable to a medial portion 68 of the strap 56 securing the cover 50 to the shoe 42.

The medial section 18 of the base wall 12 may be angled relative to the front section 14 and the back section 16 such that the medial section 18 extends rearwardy and laterally across the shoe 42 from the front section 14 towards the rear section 16 when the cover 50 is coupled to the shoe 42. More particularly, the medial section 18 of the base wall 12 may extend from an outer side 70 of the cover 50 to an inner side 72 of the cover 50 relative to the shoe 42 as the medial section 18 extends rearwardly from the front section 14 of the base wall 12.

In use, the cover 50 is positioned over the shoe 42 and secured using the strap 56 to hold the cover 50 over the shoe 42 while driving a vehicle. A single device 10 may be provided or a complementary pair may be provided to permit covering of a pair of shoes.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A shoe having a sole, a front portion and a heel portion comprising a shoe protecting cover device; wherein the shoe protecting cover device comprises:

a base wall having a front section, a rear section, and a medial section extending between said front section and said rear section, an outer side of said front section of said base wall having a length greater than an inner side of said front section of said base wall;

a perimeter wall coupled to and extending from said front section, said perimeter wall and said front section of said base wall defining a front cup having a closed front end and an open back end wherein said front cup is positionable to receive and extend over said front portion of said shoe;

an arcuate sidewall coupled to and extending upwardly from said rear section of said base wall, said sidewall and said rear section of said base wall defining a heel cup positionable to receive and extend around said heel portion of said shoe;

wherein said front cup, said heel cup, and said medial section of said base wall define a cover, an inner surface of said cover comprising a soft leather material;

a strap coupled to and extending from said cover, said strap being extendable around said shoe wherein said cover is couplable to said shoe such that said base wall extends along said sole of said shoe; and wherein said medial section of said base wall being angled relative to said front section and said back section such that said medial section extends rearwardly and laterally across said shoe from said front section towards said rear section when said cover is coupled to said shoe.

2. The device of claim 1, further comprising:

a loop coupled to a first end of said strap, a second end of said strap being insertable through said loop; and a fastener coupled to said strap wherein said second end of said strap is securable to a medial portion of said strap.

3. The device of claim 1, further comprising an outer surface of said cover comprising a durable synthetic material.

4. The device of claim 1, further comprising said medial section of said base wall extending from an outer side of said cover to an inner side of said cover as said medial section extends rearwardly from said front section of said cover.

5. The device of claim 1, further comprising a plurality of ridges extending into a bottom surface of said base wall.

6. The device of claim 5, further comprising said ridges being arranged into a front array positioned on said front section of said base wall and a heel array positioned on said rear section of said base wall.

7. The device of claim 6, further comprising said ridges of each of said front array and said heel array respectively being concentrically spaced.

8. A shoe having a sole, a front portion and a heel portion comprising a shoe protecting cover device; wherein the shoe protecting cover device comprises:

a base wall having a front section, a rear section, and a medial section extending between said front section and said rear section, an outer side of said front section of said base wall having a length greater than an inner side of said front section of said base wall;

a plurality of ridges extending into a bottom surface of said base wall, said ridges being arranged into a front array positioned on said front section of said base wall and a heel array positioned on said rear section of said base wall, said ridges of each of said front array and said heel array respectively being concentrically spaced;

a perimeter wall coupled to and extending from said front section, said perimeter wall and said front section of said base wall defining a front cup having a closed front end and an open back end wherein said front cup is positionable to receive and extend over said front portion of said shoe;

an arcuate sidewall coupled to and extending upwardly from said rear section of said base wall, said sidewall and said rear section of said base wall defining a heel cup positionable to receive and extend around said heel portion of said shoe;

wherein said front cup, said heel cup, and said medial section of said base wall define a cover, an outer surface of said cover comprising a durable synthetic material, an inner surface of said cover comprising a soft leather material;

a strap coupled to and extending from said cover, said strap being extendable around said shoe wherein said cover is couplable to said shoe such that said base wall extends along said sole of said shoe;

a loop coupled to a first end of said strap, a second end of said strap being insertable through said loop;

a fastener coupled to said strap wherein said second end of said strap is securable to a medial portion of said strap; and wherein said medial section of said base wall is angled relative to said front section and said back section such that said medial section extends rearwardly and laterally across said shoe from said front section towards said rear section when said cover is coupled to said shoe, said medial section of said base wall extending from an outer side of said cover to an inner side of said cover as said medial section extends rearwardly from said front section of said cover.

* * * * *